US010919128B2

(12) United States Patent
Chang

(10) Patent No.: US 10,919,128 B2
(45) Date of Patent: Feb. 16, 2021

(54) MODULAR SIDE-BY-SIDE VISE STRUCTURE

(71) Applicant: Chun-Wei Chang, New Taipei (TW)

(72) Inventor: Chun-Wei Chang, New Taipei (TW)

( * ) Notice: Subject to any disclaimer, the term of this patent is extended or adjusted under 35 U.S.C. 154(b) by 216 days.

(21) Appl. No.: 16/192,771

(22) Filed: Nov. 15, 2018

(65) Prior Publication Data

US 2020/0156218 A1 May 21, 2020

(51) Int. Cl.
*B25B 1/02* (2006.01)
*B25B 1/24* (2006.01)

(52) U.S. Cl.
CPC ..... *B25B 1/02* (2013.01); *B25B 1/2489* (2013.01)

(58) Field of Classification Search
CPC ..... B23Q 3/06; B23Q 3/061; B23Q 3/062; B23Q 2703/08; B23Q 2703/10; B25B 1/02; B25B 1/08; B25B 1/24; B25B 1/2473; B25B 1/2478; B25B 1/2489
USPC ..... 269/279
See application file for complete search history.

(56) References Cited

U.S. PATENT DOCUMENTS

| | | | | |
|---|---|---|---|---|
| 2,987,972 | A * | 6/1961 | Schneider | B25B 1/12 269/34 |
| 4,251,065 | A * | 2/1981 | McDougal | B25B 1/12 269/204 |
| 6,079,704 | A * | 6/2000 | Buck | B25B 1/103 269/195 |
| 6,202,997 | B1 * | 3/2001 | Yasuda | B25B 1/103 269/195 |
| 9,636,801 | B1 * | 5/2017 | Lee | B25B 1/2478 |
| 2009/0315238 | A1 * | 12/2009 | Schroeder | B25B 1/2484 269/142 |
| 2014/0131933 | A1 * | 5/2014 | Taylor | B25B 1/24 269/165 |
| 2018/0272499 | A1 * | 9/2018 | Cheng | B25B 1/02 |
| 2019/0224815 | A1 * | 7/2019 | Chen | B25B 1/08 |

* cited by examiner

*Primary Examiner* — Joshua E Rodden

(57) ABSTRACT

A modular side-by-side vise structure including a base, a fixture block group located on the base, and a side clamping piece group; the side clamping piece has an upper part and a lower part, and a bolt is screwed in the upper part to prop the lower part, so that the stopper and movable fixture block cling to the base tightly; or the side grooves on both sides of the stopper and movable fixture block are provided with bolt holes, and the inner wall of side clamping piece is provided with a punch hole, the bolt is screwed in the bolt hole through the punch hole, so that the stopper and movable fixture block cling to the base tightly. Therefore, it is unnecessary to hold up the side clamping piece with a hand while tightening or loosening the bolt, favorable for the technician to implement quick assembly or disassembly.

9 Claims, 8 Drawing Sheets

MODULAR SIDE-BY-SIDE VISE STRUCTURE

BACKGROUND OF INVENTION

1. Field of the Invention

The present invention relates to a modular side-by-side vise structure.

2. Description of Related Art

The conventional side-by-side vise structure, see Taiwan bulletin No. M560976, is a previous invention of the applicant, in which, the side clamping piece (fixture block) is fixed to the base, to loosen or tighten the bolt, the operator must hold up the side clamping piece with one hand, and tighten or loosen the bolt with the other hand, it is difficult for the technician to apply force to operation. In addition, the distance between the stopper and the movable fixture block must be adjusted according to the graduations on the base before the workpiece is clamped, which is exactly the preset clamp distance for clamping the workpiece. This action takes time, and the clamp distances for clamping workpiece are different due to different graduations, leading to dimensional tolerance problem in manufacture of workpieces.

SUMMARY OF THE INVENTION

The purpose of the present invention is to overcome the deficiencies of the prior art and to provide a modular side-by-side vise structure.

In order to solve the above technical problems, the present invention adopts the following technical solutions:

a base, both sides of which are respectively provided with a laterally extending groove;

a fixture block group, including at least a stopper and at least a movable fixture block, located on the base; a first upper bulge protruding outwards on left and right sides of the stopper respectively, a first lower bulge protruding outwards at one end far from the first upper bulge; a first side groove located between the first lower bulge and the first upper bulge; a bottom end face of the first upper bulge having a first detent; a second upper bulge protruding outwards on left and right sides of the movable fixture block respectively, a second lower bulge protruding outwards at one end far from the second upper bulge; a second side groove located between the second lower bulge and the second upper bulge; a bottom end face of the second upper bulge having a second detent; and a side clamping piece group, including a plurality of side clamping pieces (31); wherein every two side clamping pieces are a group, located on the right and left sides of the stopper and movable fixture block; an inner side wall of the side clamping piece has upper and lower side bulges protruding in the same direction; an inwardly dished connection wall located between the upper and lower side bulges; a positioning lug protruding from a top surface of the upper side bulge; wherein the positioning lug is embedded in the first and the second detent respectively for clamping, so that the side clamping piece is fixed to the base as the positioning lugs are clamped in the first and the second detent; and an upper part and a lower part protruding oppositely on one side of the side clamping piece far from the upper and lower side bulges; wherein the upper part has a vertically through bolt hole, when the bolt is screwed in the hole to prop the top side of lower part, the connection wall is taken as pivot, so that the lower side bulge clamps the upper side face of the groove upwards, the stopper or movable fixture block can cling to base tightly.

Effects of the Present Invention

First, the positioning lug is embedded in the first and the second detent, so that the technician can tighten or loosen the bolt easily without using a hand to hold up the side clamping piece when tightening or loosening the side clamping piece, quick assembly and disassembly are implemented.

Second, the cushion block can fix the clamp distance for clamping the workpiece between the stopper and movable fixture block, so as to solve the problem that the clamp distance must be adjusted according to the graduations on the base in advance, that is time consuming and likely to result in dimensional tolerance in manufacture of various workpieces.

DETAILED DESCRIPTION OF THE INVENTION

Figure 1:
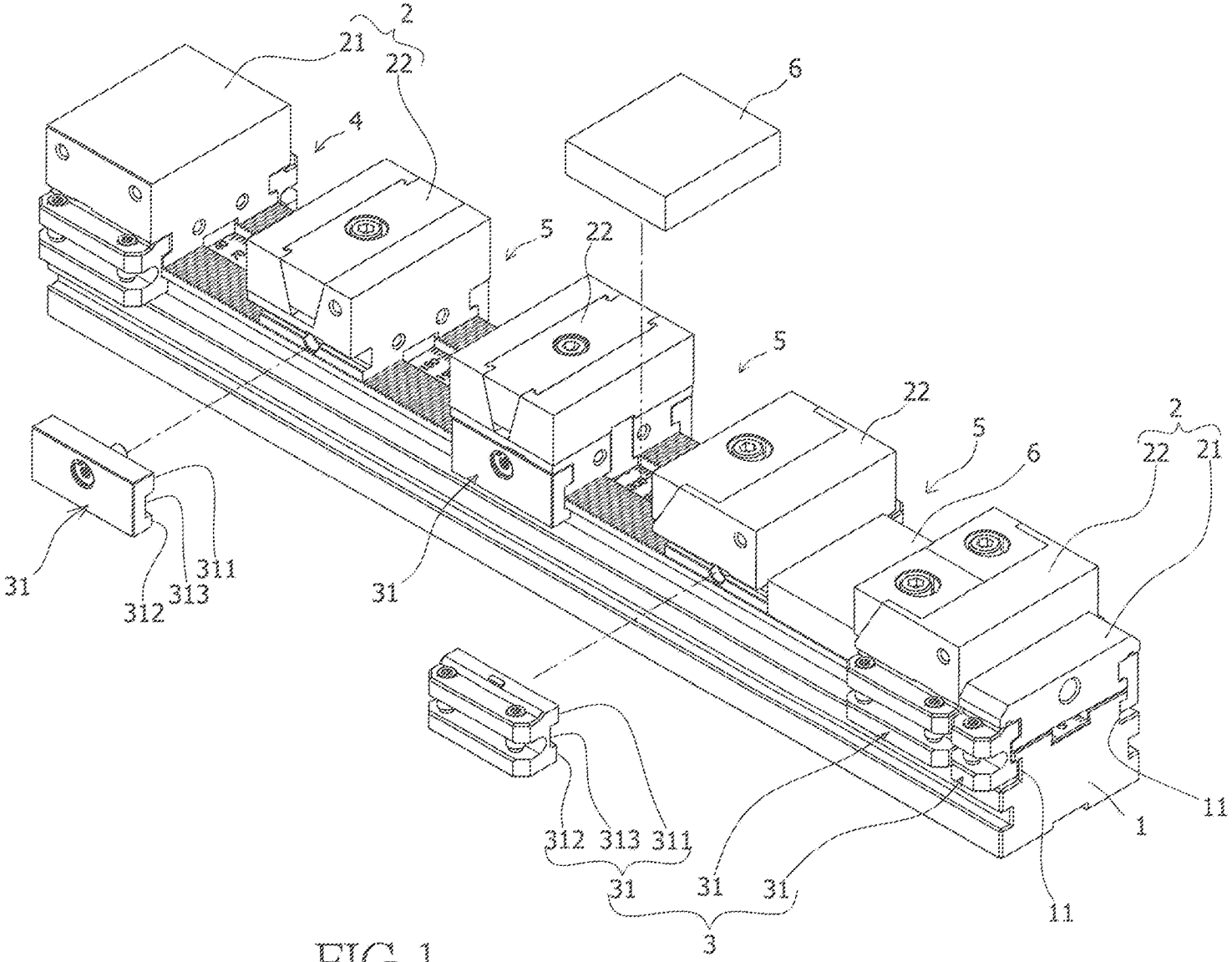
FIG. 1 is a three-dimensional diagram of joint implementation of two implementation patterns of the present invention.

FIG. 1 discloses the modular side-by-side vise structure of the present invention, which comprises a base 1, a fixture block group 2 and a side clamping piece group 3. The fixture block group 2 comprises at least a stopper 21 and at least a movable fixture block 22. The stopper 21 is located in one end and/or the other end of base 1. The size of the stopper 21 can be determined as required. For example, the left end stopper 21 has larger volume than the right end stopper 21 in the figure. The movable fixture block 22 is located on base 1 and can be shifted right and left before it is fixed. The movable fixture block 22 has multiple structures, four structures are shown in the figure from left to right, which are one-sided translational fixture block, two-sided translational fixture block, one-sided tilt fixture block and one-sided two-tilt fixture block. The stopper 21 and four structures of movable fixture block 22 have been applied for in previous invention (see U.S. Ser. No. 16/175,841) of the applicant, not to be described hereby. The present invention is characterized by the fitted structure of side clamping piece group 3, base 1 and fixture block group 2. The side clamping piece group 3 is implemented by every two side clamping pieces 31 as one group, provided on the right and left sides of stopper 21 and movable fixture block 22, so that it is fixed to base 1.

Figure 2:
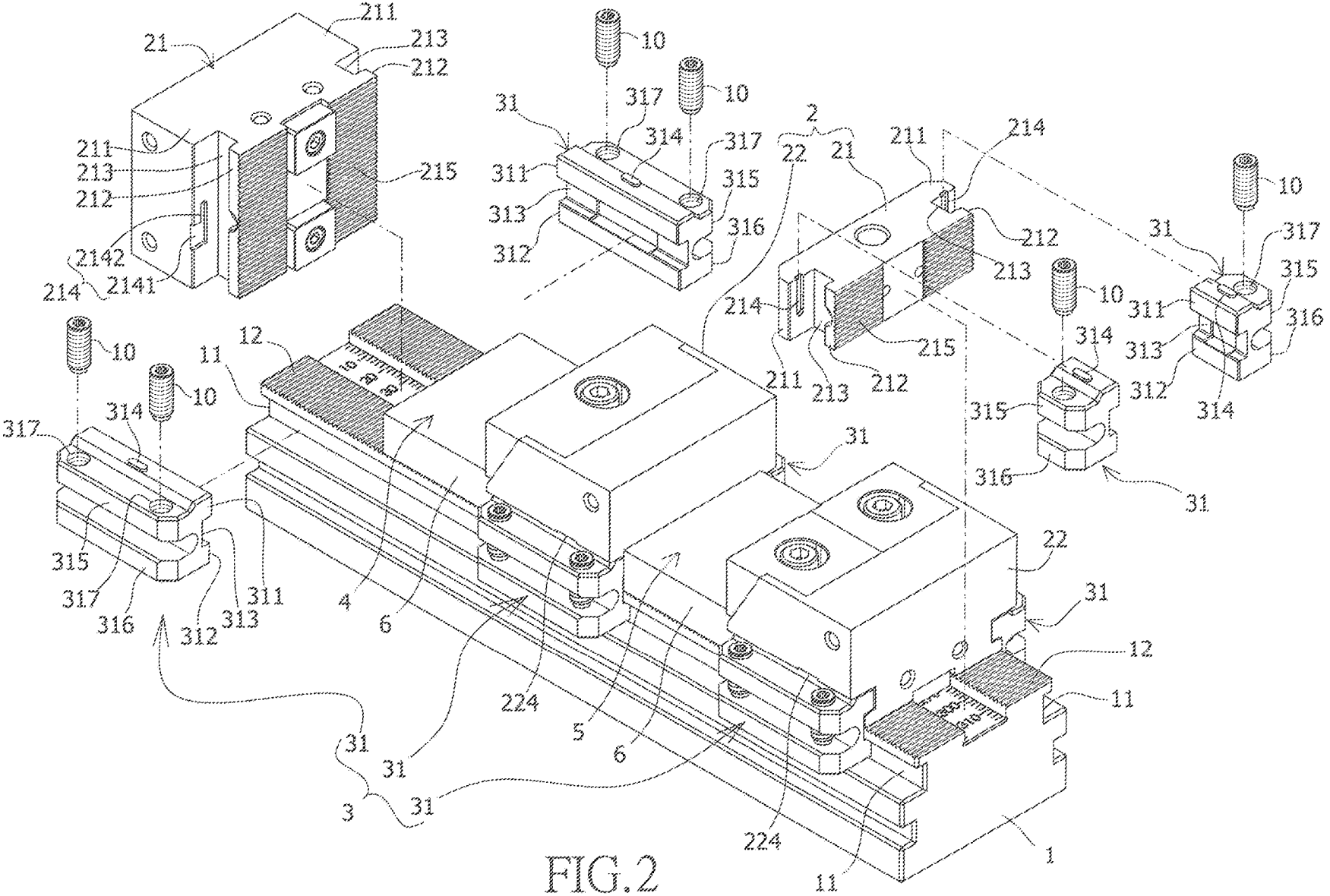
FIG. 2 is a three-dimensional exploded diagram of the first implementation pattern of the present invention.
Figure 7:
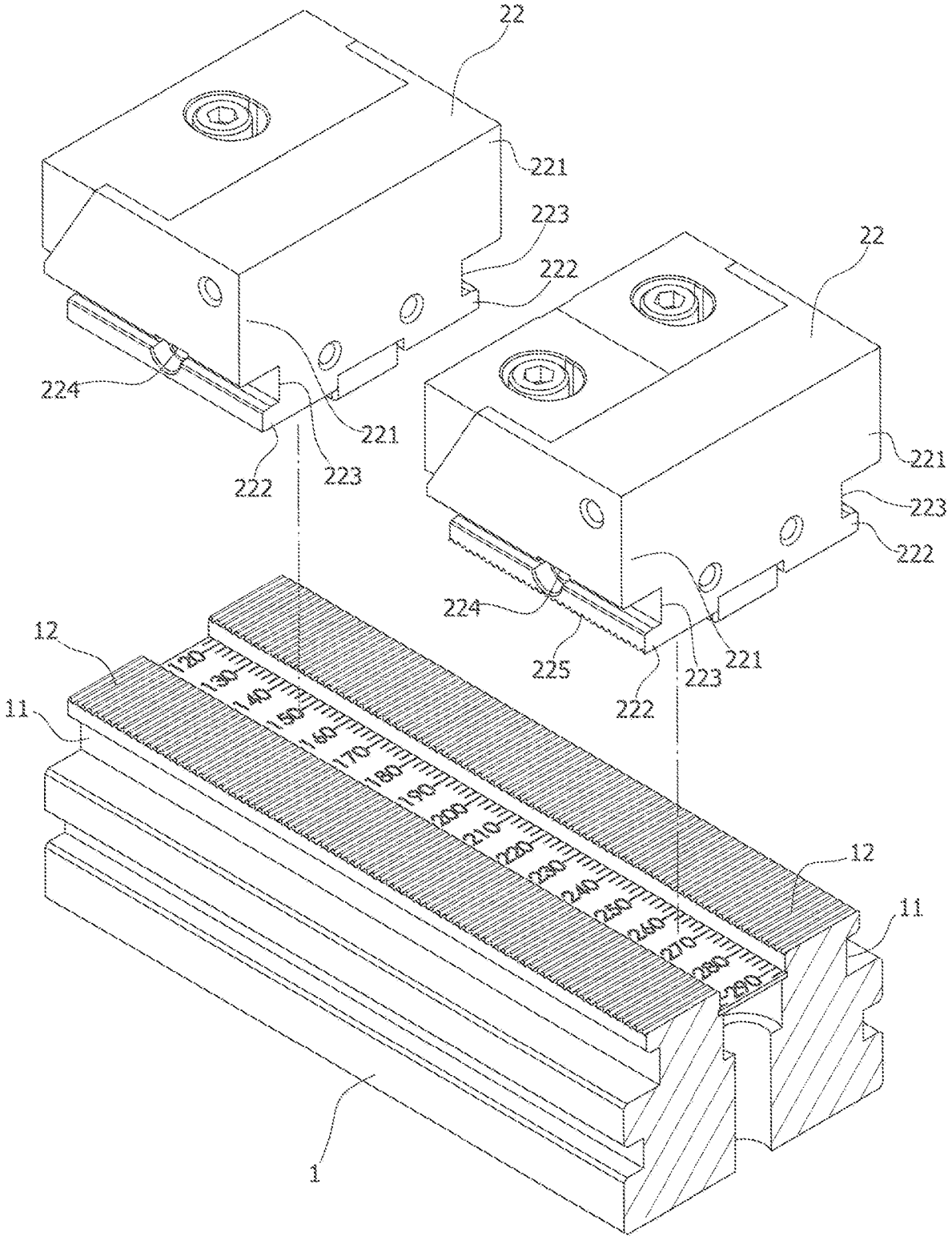
FIG. 7 is an exploded diagram of coordination of stopper, movable fixture block and base in the first implementation pattern of the present invention.

FIG. 2 shows the first implementation pattern of the present invention, as shown in FIG. 1, the modular side-by-side vise structure comprises a base 1, both sides are provided with a transcurrent groove 11 respectively; a fixture block group 2, comprising at least a stopper 21 and at least a movable fixture block 22, located on base 1. A first upper bulge 211 protrudes outwards on the left and right sides of the stopper 21 respectively, a first lower bulge 212 protrudes outwards at one end far from the first upper bulge 211 respectively. A first side groove 213 is located between the first lower bulges 212 and the first upper bulges 211 respectively. The bottom end faces of the first upper bulges 211 are provided with a first detent 214 respectively. As shown in FIG. 7, a second upper bulge 221 protrudes outwards on the left and right sides of the movable fixture block 22 respectively, a second lower bulge 222 protrudes outwards at one end far from the second upper bulges 221 respectively. A second side groove 223 is located between the second lower bulges 222 and the second upper bulges 221 respectively. The bottom end faces of the second upper bulges 221 are provided with a second detent 224 respectively; and a side clamping piece group 3 comprising several side clamping pieces 31, every two side clamping pieces 31 form a group, located on the right and left sides of stopper 21 and movable fixture block 22. As shown in FIG. 2, the inner side wall of the side clamping piece 31 is provided with upper and lower side bulges 311, 312 protruding in the same direction. An inwardly dished connection wall 313 is located between the upper and lower side bulges 311, 312, and a positioning lug 314 protrudes from the top surface of the upper side bulge 311, the positioning lugs 314 are embedded in the first and the second detent 214, 224 respectively for clamping (to be detailed), so that the side clamping pieces 31 are fixed to base 1 as the positioning lugs 314 are clamped in the first and the second detent 214, 224. An upper part 315 and a lower part 316 protrude oppositely on one side of the side clamping piece 31 far from the upper and lower side bulges 311, 312. The upper part 315 is provided with two vertically through bolt holes 317.

Figure 6:
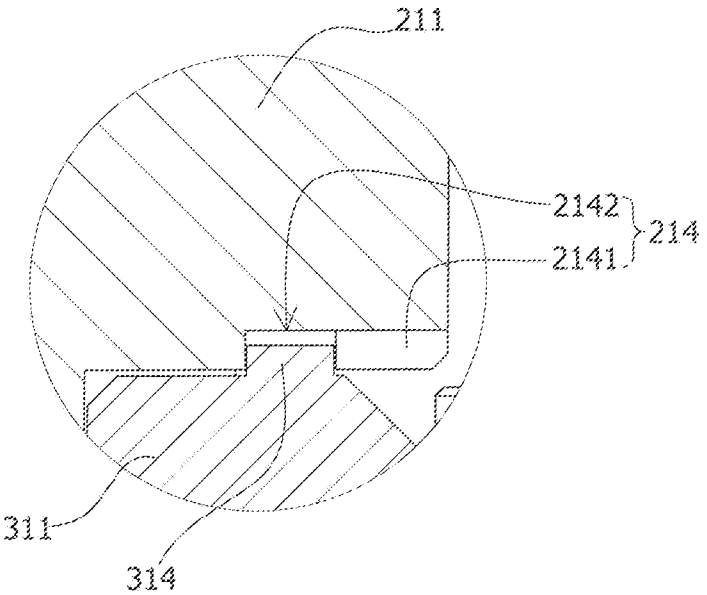
FIG. 6 is an enlarged view of Part A of FIG. 5.
Figure 5:
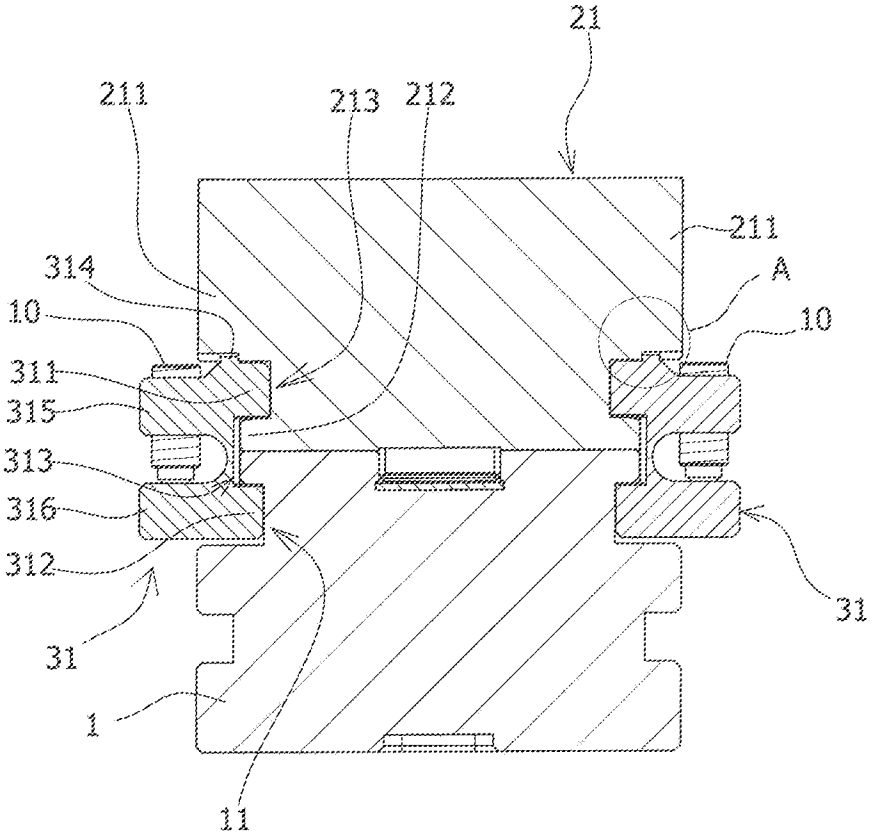
FIG. 5 is a sectional view of the stopper embedded with side clamping piece in the first implementation pattern of the present invention.

As shown in FIG. 5 and FIG. 6, the stopper 21 is located in one end and/or the other end of base 1. To assemble the side clamping piece 31 and stopper 21, the upper and lower side bulges 311, 312 of side clamping piece 31 are put in groove 11 and the first side groove 213 respectively, so that the stopper 21 clings to base 1, and the positioning lug 314 of side clamping piece 31 is embedded in the first detent 214 for clamping, and the stopper 21 and side clamping piece 31 are located on base 1 steadily. Finally, a bolt 10 screws through the bolt hole 317 and props the top side of lower part 316, the connection wall 313 is taken as pivot, so that the lower side bulge 312 clamps the upper side face of groove 11 upward, and the stopper 21 clings to base 1 tightly.

In a similar way, the movable fixture block 22 is located on base 1. To assemble the side clamping piece 31 and movable fixture block 22, the upper and lower side bulges 311, 312 of side clamping piece 31 are put in groove 11 and the second side groove 223 respectively, so that the movable fixture block 22 clings to base 1 tightly, and the positioning lug 314 of side clamping piece 31 is embedded in the second detent 224 for clamping, so that the movable fixture block 22 and side clamping piece 31 are located on base 1 steadily. Finally, a bolt 10 screws through the bolt hole 317 and props the top side of lower part 316, the connection wall 313 is taken as pivot, so that the lower side bulge 312 clamps the upper side face of groove 11 upward, and the movable fixture block 22 clings to base 1 tightly.

In addition, according to the aforesaid assembly of side clamping piece 31, stopper 21 and movable fixture block 22, as the positioning lug 314 is embedded in the first and the second detent 214, 224, it is unnecessary for the technician to hold up the side clamping piece 31 with one hand while tightening or loosening the bolt 10, so as to implement quick assembly and disassembly.

As shown in FIG. 2, a first workpiece holding space 4 is located between the stopper 21 and movable fixture block 22. A second workpiece holding space 5 is located between the movable fixture blocks 22. The first and the second workpiece holding space 4, 5 are provided with a cushion block 6 respectively. With the cushion block 6, the clamp distance for clamping the workpiece between the stopper 21 and movable fixture block 22 can be fixed rapidly, so as to solve the problem that the clamp distance shall be adjusted according to the graduations on the base in advance, that is time consuming and likely to result in dimensional tolerance in manufacture of workpieces.

Figure 3:
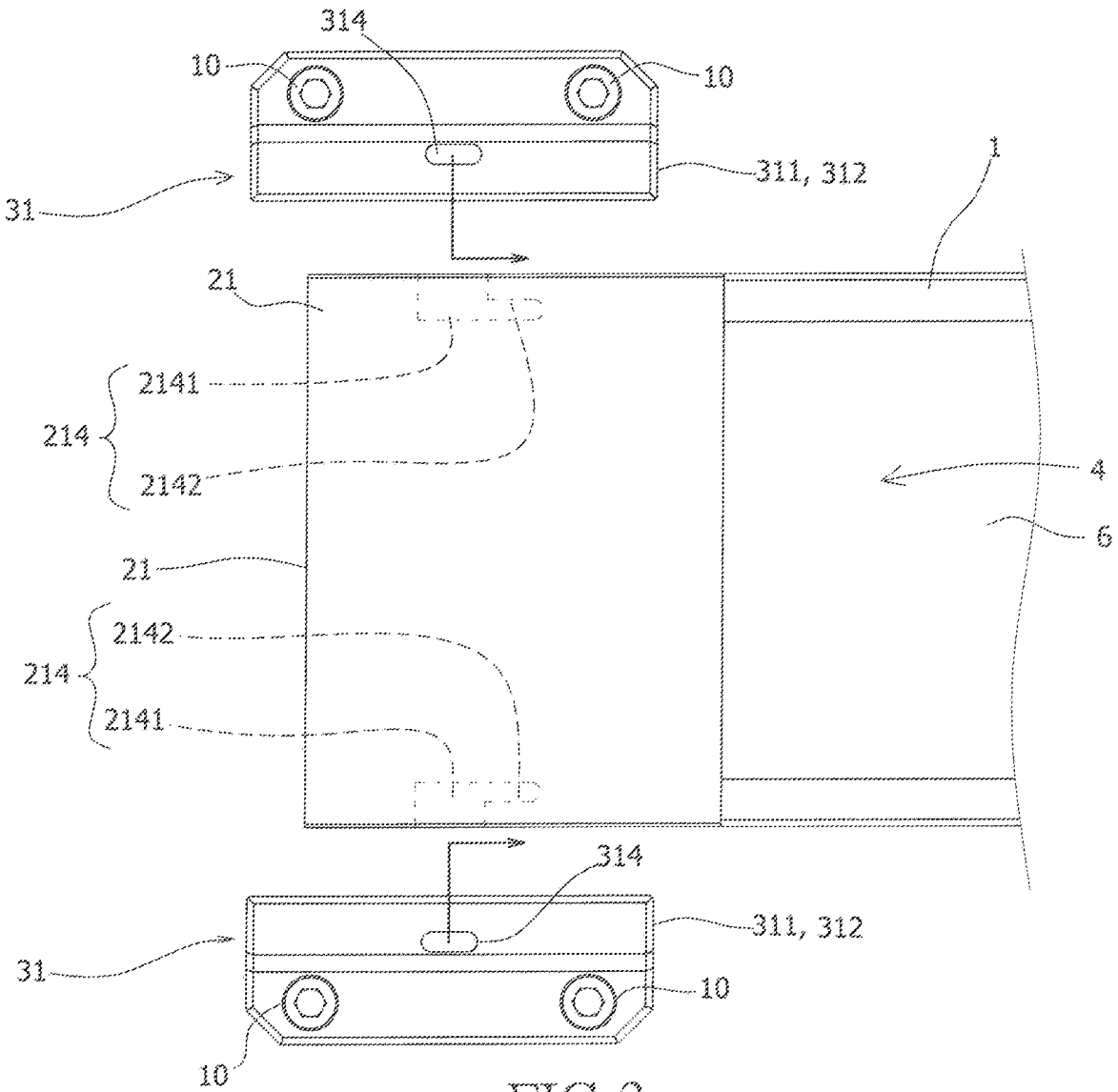
FIG. 3 is a schematic diagram of embedding the side clamping piece in the stopper in the first implementation pattern of the present invention.
Figure 4:
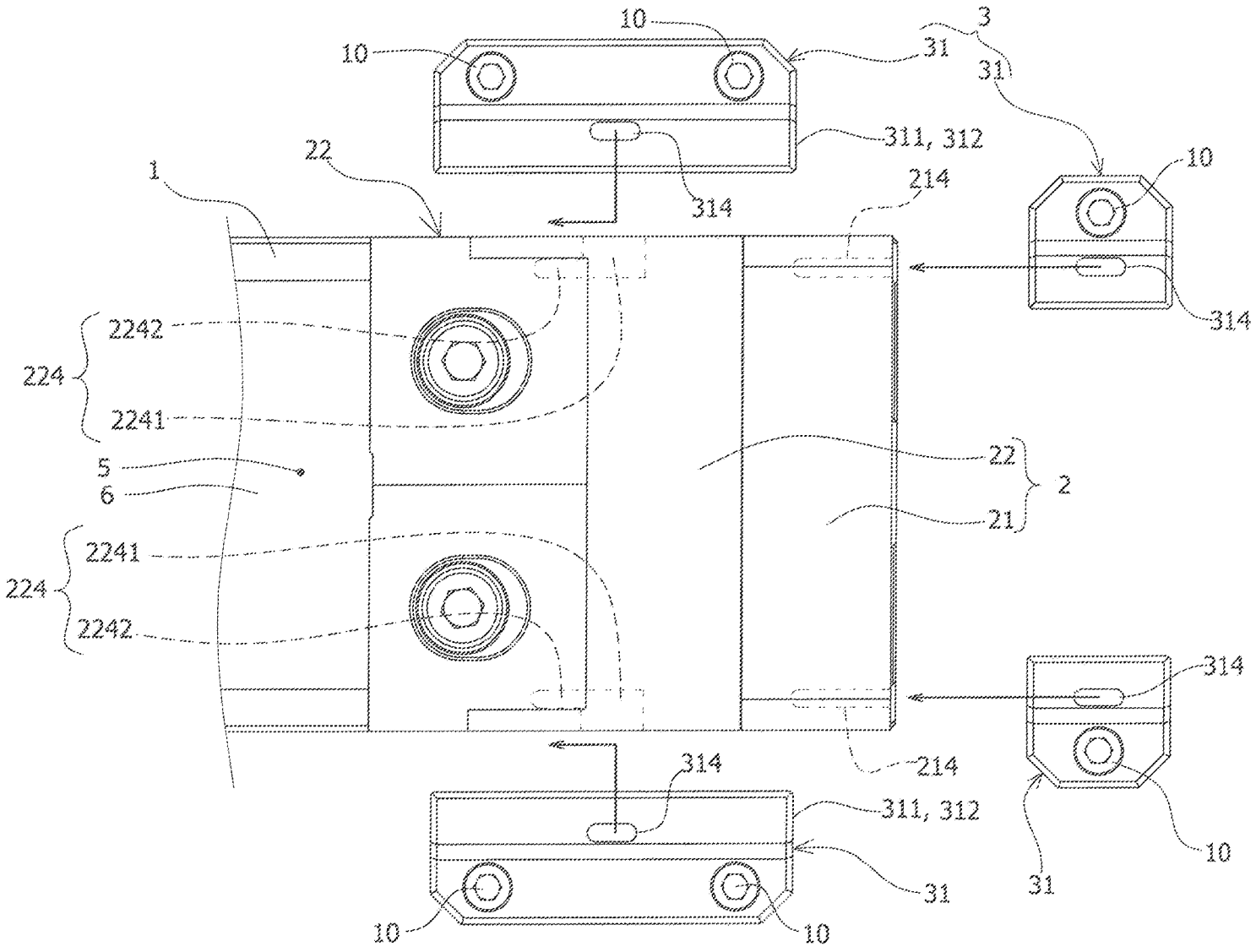
FIG. 4 is a schematic diagram of embedding the side clamping piece in the movable fixture block in the first implementation pattern of the present invention.

As shown in FIG. 2, there are two forms of the first detent 214, see the stopper 21 in the upper right of the figure for the first form, its first detent 214 is the outward long groove located in the bottom end face of the first upper bulge 211, the positioning lug (314) of side clamping piece (31) can be admitted into the first detent (214) from the front or rear end of base (1); see the stopper 21 in the upper left of the figure for the second form, its first detent 214 comprises a sideward first notch 2141 located in the bottom end face of the first upper bulge 211 and a first slim groove 2142 connected to the first notch 2141. As shown in FIG. 3, the first detent 214 is L-shaped in top view, the positioning lug (314) of side clamping piece (31) can be admitted into the first detent (214) from the outside of base (1). As shown in FIG. 4, the second detent 224 comprises a second notch 2241 located in the outer edge of bottom end face of the second upper bulge 221 and a second slim groove 2242 connected to the second notch 2241, it is L-shaped in top view, the positioning lug (314) of side clamping piece (31) can be admitted into the second detent (224) from the outside of base (1).

As shown in FIG. 2, FIG. 5 and FIG. 6, the positioning lug 314 can be led in the first detent 214 and the second detent 224. To lead the positioning lug 314 in the first detent 214 of the upper right stopper 21 in FIG. 2, the side clamping piece 31 is admitted to one end of base 1. To lead the positioning lug 314 in the first detent 214 of the upper left stopper 21 in FIG. 2, the side clamping piece 31 is admitted to both sides of base 1, it slides in the first and the second notch 2141, 2241 quickly, and it is embedded in the first and the second slim groove 2142, 2242. As shown in FIG. 5 and FIG. 6, so that the positioning lug 314 can be integrated with the first and the second detent 214, 224 tightly. Thus, the bonding point search time is saved for the technician, the work hours are reduced and the assembly is quick.

As shown in FIG. 2 and FIG. 7, the top surface of the base 1 is provided with at least a multitooth upper salient tooth row 12, that located on the right and left sides is preferred. The stopper 21 and movable fixture block 22 are provided with a first and a second lower salient tooth row 215, 225 which can engage with the upper salient tooth row 12 corresponding to the top surface of the base 11. The first and the second lower salient tooth row 215, 225 engage with the upper salient tooth row 12, so that the stopper 21 and movable fixture block 22 can cling to base 1 tightly.

Secondly, the bottom surface of the movable fixture block 22 corresponding to the top surface of base 11 can be a smooth surface, so the cushion block 6 can prop the movable fixture block 22 to avoid slide displacement when tightening or loosening the side clamping piece 31, which can result in dimensional tolerance problem in manufacture of workpieces.

Figure 8:
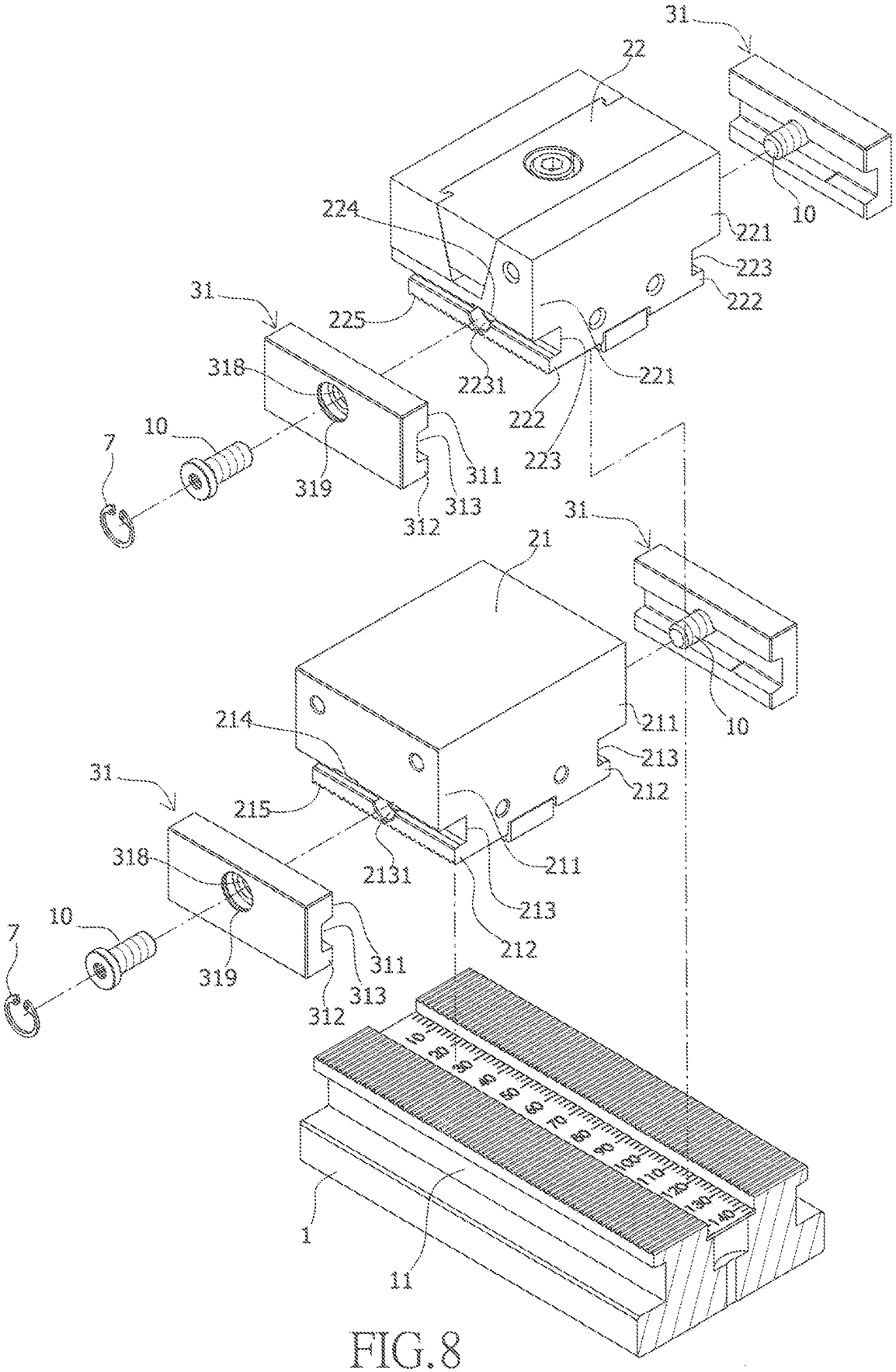
FIG. 8 is a three-dimensional diagram of the second implementation pattern of the present invention.
Figure 9:
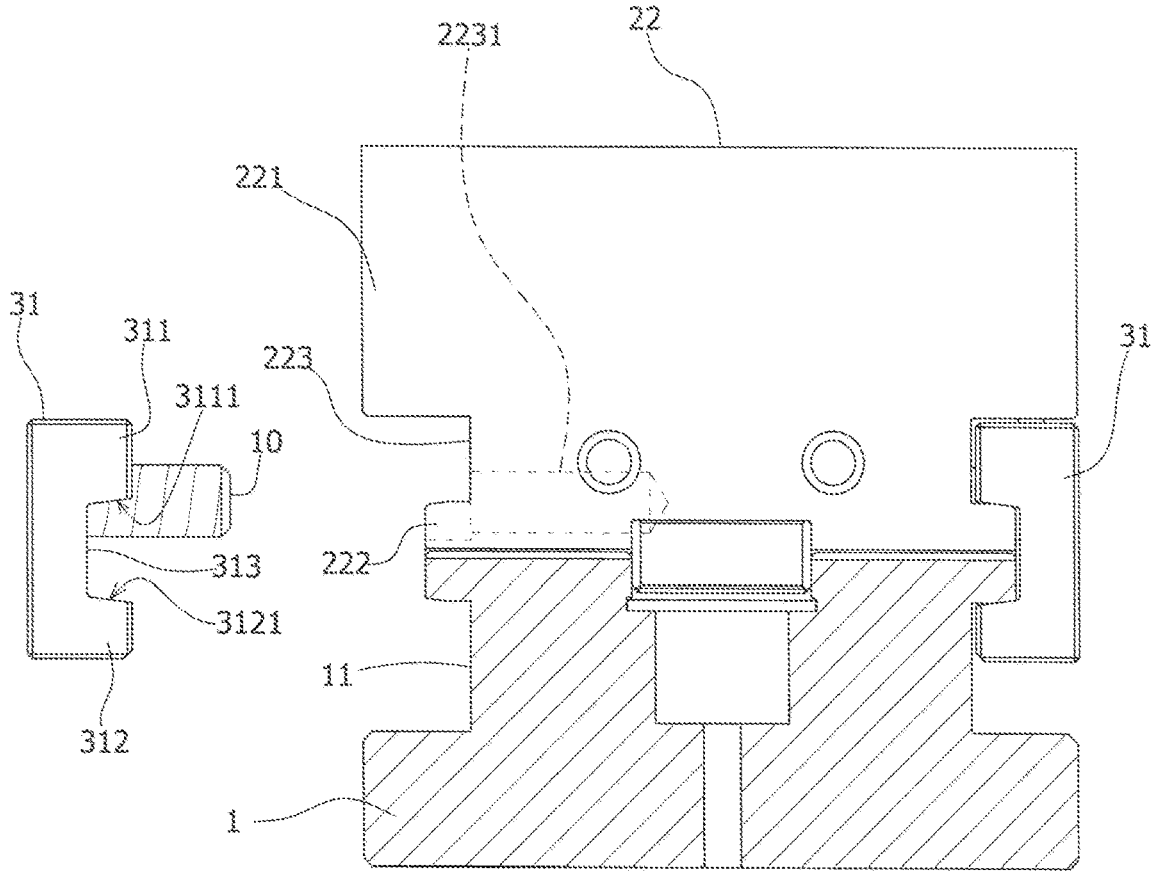
FIG. 9 is a schematic plan of the second implementation pattern of the present invention.
Figure 10:
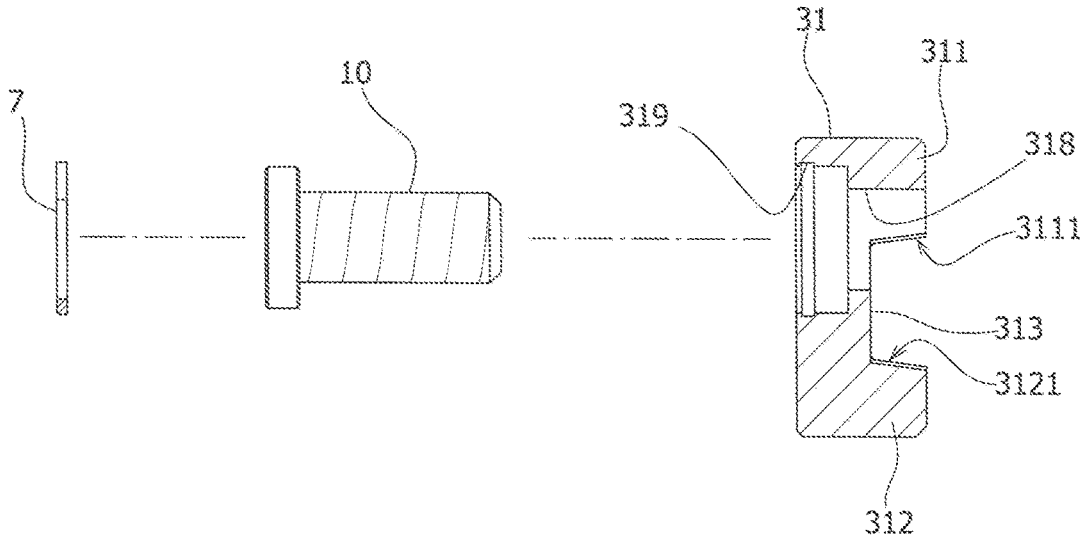
FIG. 10 is a schematic section of the side clamping piece in the second implementation pattern of the present invention.

Finally, FIG. 8 to FIG. 10 show the second implementation pattern of the present invention, differing from the first implementation pattern, one side of the first groove 213 of the stopper 21 is provided with a first bolt hole 2131, and one side of the second side groove 223 of the movable fixture block 22 is provided with a second bolt hole 2231. In addition, the bottom end face of the upper side bulge 311 of the side clamping piece 31 has an upper bevel face 3111, and the top surface of the lower side bulge 312 has a lower bevel face 3121. There is a transversely through long hole 318 corresponding to the first and the second bolt hole 2131, 2231 is located in the side face of the side clamping piece 31. One side of the long hole 318 far from the upper side bulge 311 is provided with a hole slot 319. A C-shaped clip ring 7 is located in the hole slot 319 to prevent a bolt 10 from being loosened outward after it is screwed in bolt holes 2131, 2231 through the long hole 318.

For reducing the material consumption and volume of the side clamping piece 31 in the second implementation pattern, the upper part 315 and lower part 316 of side clamping piece 31 in the first implementation pattern are not needed anymore, and the longitudinal bolt hole 317 is not required.

As shown in FIG. 10, the long hole 318 penetrates through the side clamping piece 31, and it is connected to connection wall 313, but the center of the hole is in relatively upper part of side clamping piece 31, so that the bolt 10 only tightens stopper 21 or movable fixture block 22.

In practical application, the upper and lower side bulges 311, 312 of the side clamping piece 31 are driven in the groove 11 and the first side groove 213 respectively by screwing a bolt 10 in the first bolt hole 2131 through the long hole 318, and the upper bevel face 3111 approaches the top surface of the first lower bulge 212 gradually, so that the stopper 21 clings to base 1 tightly for positioning. In a similar way, the upper and lower side bulges 311, 312 of a part of side clamping pieces 31 are driven in the groove 11 and the second side groove 223 as a bolt 10 is screwed in the second bolt hole 2231 through the long hole 318, and the upper bevel face 3111 approaches the bottom end face of the second upper bulge 221 gradually, so that the movable fixture block 22 clings to base 1 tightly for positioning.

The above only describes some exemplary embodiments of the present invention. Those having ordinary skills in the art may also make many modifications and improvements without departing from the conception of the invention, which shall all fall within the protection scope of the invention.

I claim:

1. A modular side-by-side vise structure, comprising:

a base (1), both sides of which are respectively provided with a laterally extending groove (11);

a fixture block group (2), including a plurality of stoppers (21) and at least movable fixture blocks (22), located on the base (1); a first upper bulge (211) protruding outwards on left and right sides of the stopper (21) respectively, a first lower bulge (212) protruding outwards at an opposite end from the first upper bulge (211); a first side groove (213) located between the first lower bulge (212) and the first upper bulge (211); a bottom end face of the first upper bulge (211) having a first detent (214); a second upper bulge (221) protruding outwards on left and right sides of the movable fixture block (22) respectively, a second lower bulge (222) protruding outwards at an opposite end from the second upper bulge (221); a second side groove (223) located between the second lower bulge (222) and the second upper bulge (221); a bottom end face of the second upper bulge (221) having a second detent (224); and a side clamping piece group (3), including a plurality of side clamping pieces (31); wherein every two side clamping pieces (31) are a group, located on the right and left sides of the stopper (21) and movable fixture block (22), respectively; an inner side wall of each of the side clamping pieces (31) has upper and lower side bulges (311, 312) protruding in the same direction; each of the side clamping pieces (31) including an inwardly dished connection well (313) located between the upper and lower side bulges (311, 312); each of the side clamping pieces (31) including a positioning lug (314) protruding from a top surface of the upper side bulge (311); wherein the positioning lug (314) is configured to be in the first and the second detent (214, 224) respectively for clamping, so that the side clamping piece (31) is fixed to the base (1) as the positioning lugs (314) are clamped in the first and the second detent (214, 224); and an upper part (315) and a lower part (316) protruding oppositely on one side of the side clamping piece (31) at an opposite side from the upper and lower side bulges (311, 312); wherein the upper part (315) has a vertically through bolt hole (317), when the bolt (10) is screwed in the hole to prop the top side of lower part (316), the connection wall (313) is taken as pivot, so that the lower side bulge (312) clamps an upper side face of the groove (11) upwards, the stopper (21) or movable fixture block (22) configured to cling to base (1) tightly.

2. The modular side-by-side vise structure according to claim 1, wherein a first workpiece holding space (4) is located between the stopper (21) and the movable fixture block (22); a second workpiece holding space (5) is provided between the movable fixture blocks (22); the first and the second workpiece holding space (4, 5) are provided with a cushion block (6) respectively.

3. The modular side-by-side vise structure according to claim 1, wherein the base (1) includes a multi-tooth upper salient tooth row (12) disposed at a top surface thereof; the stopper (21) and movable fixture block (22) includes a first and a second lower salient tooth row (215, 225) which are configured to engage with the upper salient tooth row (12) respectively corresponding to the top surface of base (11).

4. The modular side-by-side vise structure according to claim 1, wherein the first detent (214) is an outward long groove located in the bottom end face of the first upper bulge (211), the positioning lug (314) of the side clamping piece (31) configured to led in the first detent (214) from a front or rear end of the base (1).

5. The modular side-by-side vise structure according to claim 1, wherein the first detent (214) includes a sideward first notch (2141) located in the bottom end face of the first upper bulge (211) and a first slim groove (2142) connected to the first notch (2141); the positioning lug (314) of the side clamping piece (31) configured to led in the first detent (214) from the outside of base (1).

6. The modular side-by-side vise structure according to claim 1, the second detent (224) comprises a sideward second notch (2241) located in the bottom end face of the second upper bulge (221) and a second slim groove (2242) connected to the second notch (2241); the positioning lug (314) of side clamping piece (31) configured to led in the second detent (224) from the outside of base (1).

7. A modular side-by-side vise structure, comprising:

a base (1), both sides of which are respectively provided with a laterally extending groove (11);

a fixture block group (2), including at least a stopper (21) and at least a movable fixture block (22), located on the base (1); a first upper bulge (211) protruding outwards on left and right sides of the stopper (21) respectively, a first lower bulge (212) protruding outwards at an opposite end from the first upper bulge (211); a first side groove (213) located between the first lower bulge (212) and the first upper bulge (211); a side face of the first side groove (213) having a first bolt hole (2131); a second upper bulge (221) protruding outwards on left and right sides of the movable fixture block (22) respectively, a second lower bulge (222) protruding outwards at an opposite end from the second upper bulge (221); a second side groove (223) located between the second lower bulge (222) and the second upper bulge (221); the side of the second side groove (223) having a second bolt hole (2231); and a side clamping piece group (3), including a plurality of side clamping pieces (31), wherein every two side clamping pieces (31) are a group, located on the right and left sides of the stopper (21) and movable fixture block (22), respectively; each side clamping piece (31) has upper and lower side bulges (311, 312) protruding in the same direction; each of the side clamping pieces (31) including a connection wall (313) located between the upper and lower side bulges (311, 312); wherein the side face of the side clamping piece (31) includes a transversely through the long hole (318) corresponding to the respective first and the second bolt hole (2131, 2231); a respective bolt (10) is screwed in the first and the second bolt hole (2131, 2231) through the long hole (318), the stopper (21) or movable fixture block (22) configured to cling to base (1) tightly.

8. The modular side-by-side vise structure according to claim 7, wherein the long hole (318) penetrates through the side clamping piece (31) and communicates with the connection wall (313), a center of the long hole is in a relatively upper part of the side clamping piece (31).

9. The modular side-by-side vise structure according to claim 7, wherein the bottom end face of upper side bulge (311) of the side clamping pieces (31) has an upper bevel face (3111), and the top surface of the lower side bulge (312) has a lower bevel face (3121).

* * * * *